US005309081A

United States Patent [19]

Shah et al.

[11] Patent Number: 5,309,081

[45] Date of Patent: May 3, 1994

[54] POWER CONVERSION SYSTEM WITH DUAL PERMANENT MAGNET GENERATOR HAVING PRIME MOVER START CAPABILITY

[75] Inventors: Mahesh J. Shah, Rockford; Alexander Cook, Machesney, both of Ill.

[73] Assignee: Sundstrand Corporation, Rockford, Ill.

[21] Appl. No.: 931,636

[22] Filed: Aug. 18, 1992

[51] Int. Cl.[5] ..... F02N 11/04

[52] U.S. Cl. ..... 322/10; 322/29; 290/46

[58] Field of Search ..... 322/10, 11, 29, 32, 322/61, 24; 290/10, 22, 31, 38 R, 46

[56] References Cited

U.S. PATENT DOCUMENTS

| | | | |
|---|---|---|---|
| 1,444,012 | 6/1915 | Walton . | |
| 2,500,730 | 3/1950 | Yonkers . | |
| 2,784,332 | 3/1957 | Kober | 310/191 |
| 2,824,275 | 2/1958 | Kober | 322/27 |
| 2,831,156 | 4/1958 | Mathews, Jr. et al. | 322/24 |
| 2,837,710 | 6/1958 | Keller | 322/24 |
| 2,852,731 | 9/1958 | Heil | 322/24 |
| 2,886,762 | 5/1959 | Polasek | 322/24 |
| 2,887,645 | 5/1959 | Polasek | 322/31 |
| 3,056,914 | 10/1962 | Potter | 322/40 |
| 3,200,324 | 8/1965 | Wagner | 322/32 |
| 3,215,876 | 11/1965 | Nichols et al. | 310/156 |
| 3,233,133 | 2/1966 | Kober | 310/191 |
| 3,242,365 | 3/1966 | Kober | 310/268 |
| 3,459,980 | 8/1969 | Coroller | 310/114 |
| 3,483,463 | 12/1969 | Smith | 322/29 |
| 3,713,015 | 1/1973 | Frister | 322/28 |
| 4,051,423 | 9/1977 | Touchton et al. | 318/611 |
| 4,087,698 | 5/1978 | Myers | 307/84 |
| 4,228,391 | 10/1980 | Owen | 322/35 |
| 4,305,031 | 12/1981 | Wharton | 322/29 |
| 4,371,801 | 2/1983 | Richter | 310/156 |
| 4,481,459 | 11/1984 | Mehl et al. | 322/10 |
| 4,641,080 | 2/1987 | Glennon et al. | 322/49 |
| 4,663,581 | 5/1987 | Glennon | 322/52 |
| 4,704,552 | 11/1987 | Masterman | 310/148 |
| 4,728,841 | 3/1988 | Sugden | 310/114 |
| 4,743,777 | 5/1988 | Shilling et al. | 290/46 |
| 4,754,154 | 6/1988 | Motodate | 290/46 |
| 4,786,852 | 11/1988 | Cook | 322/10 |
| 4,797,602 | 1/1989 | West | 322/10 |
| 4,817,461 | 4/1989 | Iseman | 310/112 X |
| 4,862,009 | 8/1989 | King | 290/22 |
| 4,868,406 | 9/1989 | Glennon et al. | 322/29 X |
| 4,879,484 | 11/1989 | Huss | 310/114 |
| 4,882,513 | 11/1989 | Flygare et al. | 310/114 |
| 4,947,100 | 8/1990 | Dhyanchand et al. | 322/10 |
| 4,968,926 | 11/1990 | Dhyanchand | 322/10 |
| 4,992,721 | 2/1991 | Latos | 322/10 |
| 4,996,457 | 2/1991 | Hawsey et al. | 310/268 |
| 5,001,412 | 3/1991 | Carter et al. | 322/10 |
| 5,013,929 | 5/1991 | Dhyanchand | 322/29 X |
| 5,015,941 | 5/1991 | Dhyanchand | 322/10 |
| 5,021,698 | 6/1991 | Pullen et al. | 310/156 |
| 5,055,700 | 10/1991 | Dhyanchand | 290/31 |
| 5,068,590 | 11/1991 | Glennon et al. | 322/10 |
| 5,132,604 | 7/1992 | Shimane et al. | 322/10 |

FOREIGN PATENT DOCUMENTS 2007310 1/1970 France .

OTHER PUBLICATIONS

Vaidya, "Optimization of Brushless DC Motor Design", Drives and Controls International. Jun./Jul. 1982, p. 20.

*Primary Examiner*—Kristine L. Peckman

*Attorney, Agent, or Firm*—Marshall, O'Toole, Gerstein, Murray & Borun

[57] ABSTRACT

A starting/generating system operable in a starting mode and in a generating mode utilizes a dual permanent magnet generator (DPMG) having a motive power shaft and an armature winding together with a power converter having an input and an output. Relays are operable in the starting mode to connect the output of the power converter to the DPMG armature winding and are operable in the generating mode to connect the input of the power converter to the DPMG armature winding. The power converter is controlled in the starting mode such that the DPMG is operated as a motor to produce motive power at the motive power shaft and is controlled in the generating mode such that electrical power developed in the DPMG armature winding is converted into output power.

17 Claims, 3 Drawing Sheets

POWER CONVERSION SYSTEM WITH DUAL PERMANENT MAGNET GENERATOR HAVING PRIME MOVER START CAPABILITY

TECHNICAL FIELD

The present invention relates generally to power conversion systems, and more particularly to such a system which may be used in a generating mode to convert motive power developed by a prime mover into electrical power or in a starting mode to convert electrical power into motive power for starting the prime mover.

BACKGROUND ART

In a power conversion system such as a variable-speed, constant-frequency (VSCF) power generating system, a brushless, three-phase synchronous generator operates in a generating mode to convert variable-speed motive power supplied by a prime mover into variable-frequency AC power. The variable-frequency AC power is rectified and provided over a DC link to a controllable static inverter. The inverter is operated to produce constant-frequency AC power, which is then supplied over a load bus to one or more loads.

As is known, a generator can also be operated as a motor in a starting mode to convert electrical power supplied by an external AC power source into motive power which may in turn be provided to the prime mover to bring it up to self-sustaining speed. In the case of a brushless, synchronous generator including a permanent magnet generator (PMG), an exciter portion and a main generator portion mounted on a common shaft, it has been known to provide power at a controlled voltage and frequency to the armature windings of the main generator portion and to provide field current to the main generator portion via the exciter portion so that the motive power may be developed. This has been accomplished in the past, for example, using two separate inverters, one to provide power to the main generator portion armature windings and the other to provide power to the exciter portion. Thereafter, operation in the generating mode may commence whereupon DC power is provided to the exciter field winding.

Cook, U.S. Pat. No. 4,786,852, assigned to the assignee of the instant invention, discloses a power conversion system including a starting arrangement in which a brushless generator is operated as a motor to bring an engine up to self-sustaining speed. A rectifier bridge of a VSCF system is modified by adding transistors in parallel with the rectifiers of the bridge and the transistors are operated during a starting mode of operation to convert DC power provided on a DC link by a separate VSCF system or auxiliary power unit into AC power. The AC power is applied to armature windings of the brushless generator to cause a rotor of the generator to be accelerated.

Shilling, et al, U.S. Pat. No. 4,743,777 discloses a starter/generator system including a brushless, synchronous generator. The system is operated in a starting mode to produce motive power from electrical power provided by an external AC power source. An exciter of the generator includes separate DC and three-phase AC field windings disposed in a stator. When operating in a starting mode at the beginning of a starting sequence, the AC power developed by the external AC power source is directly applied to the three-phase AC exciter field windings. The AC power developed by the external AC source is further provided to a variable-voltage, variable-frequency power converter which in turn provides a controllable voltage and frequency to the armature windings of a main generator. The AC power provided to the AC exciter field windings is transferred by transformer action to exciter armature windings disposed on a rotor of the generator. This AC power is rectified by a rotating rectifier and provided to a main field winding of the generator. The interaction of the magnetic fields developed by the main generator field winding and armature winding in turn causes the rotor of the generator to rotate and thereby develop the desired motive power. When the generator is operated in a generating mode, switches are operated to disconnect the AC exciter field windings from the external AC source and to provide DC power to the DC exciter field winding. The power converter is thereafter operated to produce AC output power at a fixed frequency.

Other types of starting/generating systems are disclosed in Glennon, et al., U.S. Pat. Nos. 4,868,406 and 5,068,590, Dhyanchand, et al., U.S. Pat. No. 4,947,100 and Dhyanchand, U.S. Pat. Nos. 4,968,926, 5,013,929, 5,015,941 and 5,055,700, assigned to the assignee of the instant application.

All of the foregoing systems are useful to provide motive power for starting of a prime mover. However, all of these systems utilize brushless wound-field generators having an exciter and a PMG in addition to a main generator. Brushless wound-field generators are relatively heavy and long in the axial direction owing to the need for cascaded electromagnetic stages. Also, the use of a rotating winding and rotating rectifier limits the efficiency, ruggedness and reliability of the generator.

In addition to the foregoing, when a brushless, synchronous wound-field generator is utilized as part of a VSCF system operable in generating and starting modes, it is necessary to provide an exciter and main generator of higher power rating than if the system were used for generating alone. Thus, the size and weight of the generator must be further increased in order to accommodate the starting function.

Recent advances in magnetic materials have permitted the substitution of a PMG for the wound-field generator of a VSCF system. In this case, the PMG may be of the axial type wherein axial flux is developed by permanent magnets carried by a rotor. Control over the output voltage of a PMG may be effected by providing two (or more) relatively movable permanent magnet field structures in proximity to a single armature winding or two (or more) relatively movable, series-connected armature windings in proximity to a single permanent magnet field structure. The relative positions of the field structures or armature windings are varied to control the output voltage of the generator. Such a generator is sometimes referred to as dual permanent magnet generator (DPMG).

The use of a PMG in a VSCF starting/generating system is suggested at column 3, lines 42–45 of the above-noted Dhyanchand '929 patent, although no details are provided as to how this might be accomplished, nor is there any disclosure or suggestion that a DPMG may be used.

Axial-gap DPMG's are disclosed and claimed in Lynch, et al., U.S. patent application Ser. No. 07/693,622, filed Apr. 30, 1991, entitled "Axial Gap Dual Permanent Magnet Generator", now U.S. Pat.

No. 5,245,238 and Shah, U.S. patent application Ser. No. 07/931,168, filed Aug. 17, 1992, entitled "Permanent Magnet Generator With Auxiliary Winding", both assigned to the assignee of the instant application and the disclosures of which are hereby incorporated by reference herein.

SUMMARY OF THE INVENTION

In accordance with the present invention, a dual permanent magnet generator is used in a starting-/generating system so that size and weight can be reduced and other advantages can be realized.

More particularly, a starting/generating system operable in a starting mode and in a generating mode includes a dual permanent magnet generator (DPMG) having a motive power shaft and an armature winding, a power converter having an input and an output and relays operable in the starting mode to connect the output of the power converter to the DPMG armature winding and operable in the generating mode to connect the input of the power converter to the DPMG armature winding. Means are operable in the starting mode for controlling the power converter whereby the DPMG is operated as a motor to produce motive power at the motive power shaft and means are operable in the generating mode for controlling the power converter whereby the electrical power developed in the DPMG armature winding is converted into output power.

Preferably, the starting/generating system is operable in combination with a prime mover coupled to the motive power shaft wherein motive power produced by the DPMG during operation in the starting mode is supplied to the prime mover to bring the prime mover up to self-sustaining speed and wherein motive power produced by the prime mover during operation of the generating mode is supplied to the DPMG. Also preferably, the starting/generating system is operable in combination with a source of AC power coupled to the first input/output of the power converter during operation in the starting mode.

The DPMG may be of any type, including one having dual permanent magnet rotor structures on a rotor thereof and a stator armature winding or one in which a single permanent magnet rotor structure is disposed on the rotor and dual series-connected armature windings are disposed in the stator. The DPMG may even be of the type where armature windings are disposed on the rotor and one or more permanent magnet structures are disposed in the stator.

In accordance with the preferred embodiment, the power converter comprises a rectifier coupled between the input of the power converter and a DC link and an inverter coupled between the DC link and the output of the power converter.

The controlling means preferably includes means for sensing a parameter of operation of the DPMG during operation in the starting mode and means responsive to the sensing means for operating the inverter to control the application of power to the armature winding during operation of the starting mode. In alternative embodiments, the sensing means comprises either a position resolver which detects the position of the motive power shaft or a speed detector which detects the speed of rotation of the motive power shaft.

According to a further aspect of the present invention, a method of operating a starting/generating system includes the steps of coupling a motive power shaft of a DPMG to a prime mover, providing a power converter having an input and an output and connecting the output of the power converter to an armature winding of the DPMG. The input of the power converter is connected to a power source and the power converter is controlled so that the DPMG is operated as a motor to produce motive power which is transferred through the motive power shaft to the prime mover so that the prime mover is accelerated to self-sustaining speed. Thereafter, the input of the power converter is coupled to the DPMG armature winding and the output of the power converter is connected to a load and the power converter is controlled such that electrical power developed in the DPMG armature winding is converted into output power for the load.

The use of a DPMG, particularly a DPMG of the axial gap type, reduces the size and weight of the overall starting/generating system, improves efficiency and reliability, provides better ruggedness, reduces overhung moment and obviates the need for a rotating winding and rectifiers. In addition, protection of the system in the case of a differential fault can be readily effected by reducing the output voltage thereof to zero without the need for a mechanical disconnect.

BRIEF DESCRIPTION OF THE DRAWINGS

Other features and advantages of the present invention can be ascertained by reference to the attached specification and drawings in which.

DESCRIPTION OF THE PREFERRED EMBODIMENTS

Figure 1:
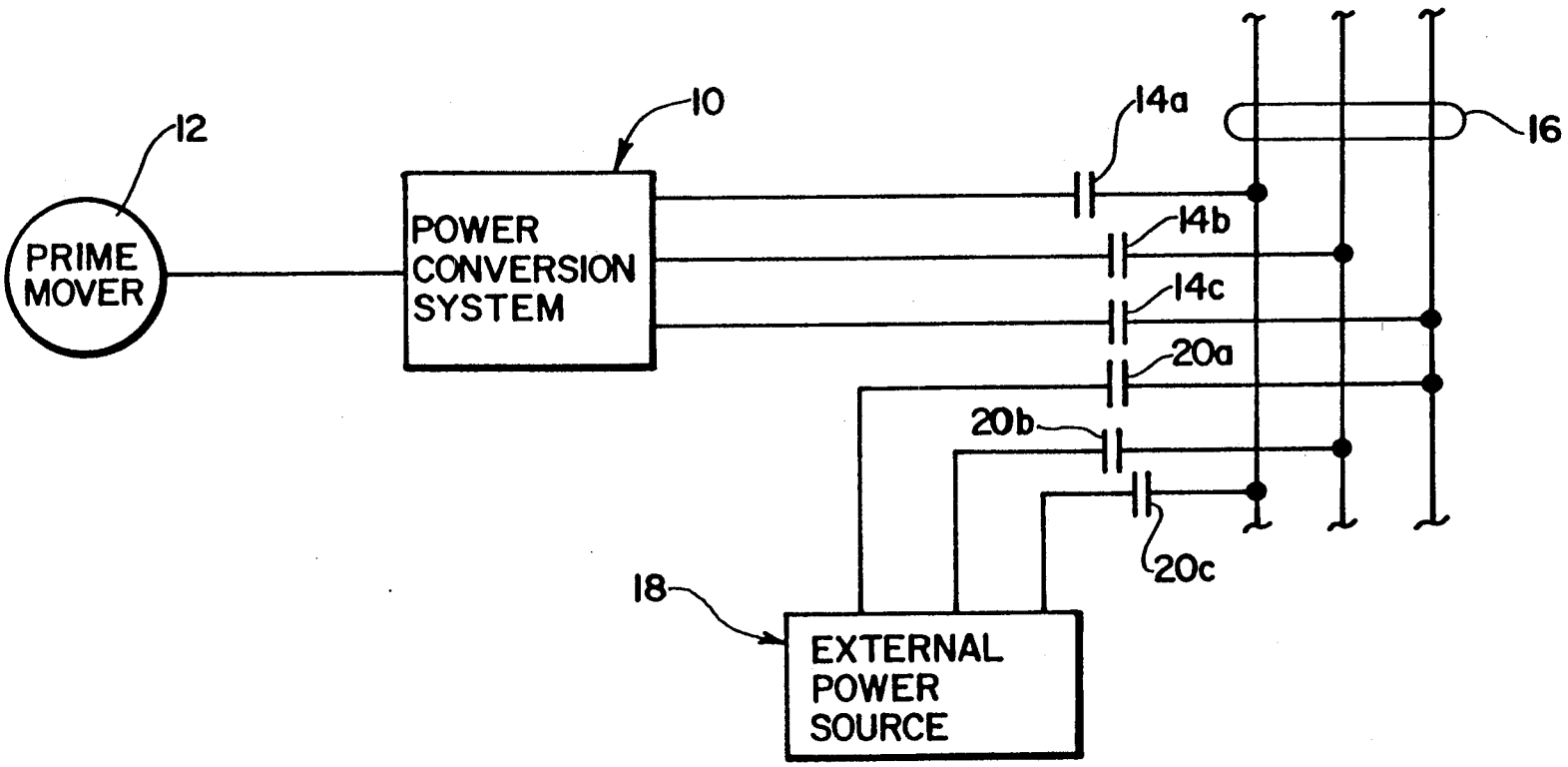
FIG. 1 is a block diagram of power generating system incorporating the present invention.

Referring now to FIG. 1, a power conversion system 10 in the form of a variable-speed, constant-frequency (VSCF) system operates in a generating mode to convert variable-speed motive power produced by a prime mover 12, such as an aircraft jet engine, into constant-frequency three-phase AC electrical power which is delivered through controllable contactors 14*a*, 14*b*, 14*c* to a load bus 16. The VSCF system 10 is also operable in a starting mode using three-phase AC power provided by an external power source 18, such as a ground power cart, which, in the starting mode, is in turn coupled to the load bus 16 through controllable contactors 20*a*–20*c*. Alternatively, the electrical power for use by the VSCF system 10 in the starting mode may be provided by another source of power, such as another VSCF system which is driven by a different prime mover. In any event, the VSCF system 10 converts electrical power into motive power when operating in the starting mode to bring the prime mover 12 up to self-sustaining speed. Once this self-sustaining speed (also referred to as "light-off") is reached, the prime mover 12 may be accelerated to operating speed, following which operation in the generating mode may commence.

Figure 2:
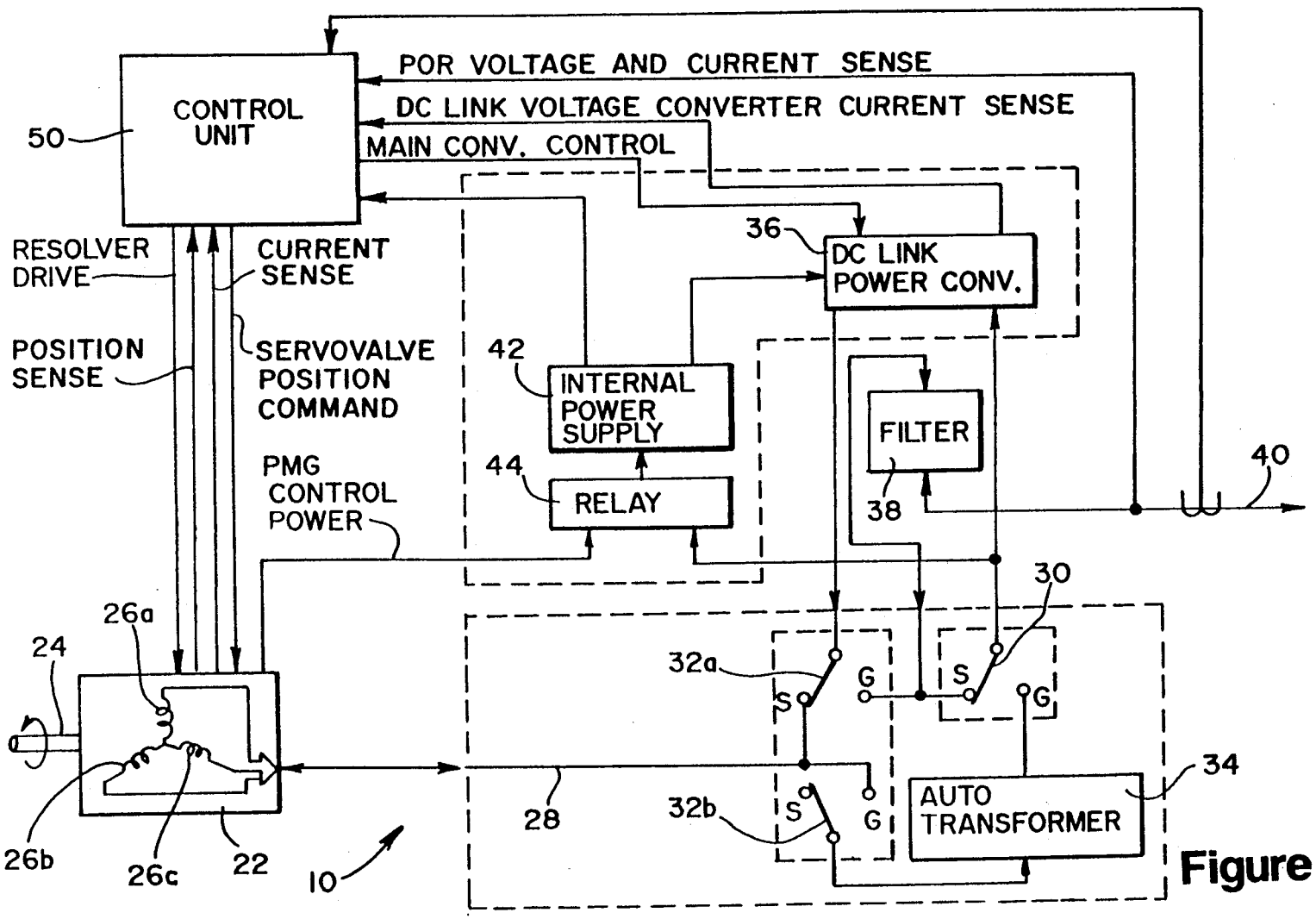
FIG. 2 comprises a combined mechanical and electrical block diagram of the power generating system shown in FIG. 1.

FIG. 2 illustrates the VSCF system 10 in greater detail, it being understood that various single lines between elements in fact represent three-phase or any other number of phase lines. As seen in FIG. 2, the VSCF system 10 includes a dual permanent magnet generator (DPMG) 22 preferably, although not necessarily, of the axial gap type, having a motive power shaft 24 coupled to the prime mover 12 and armature windings 26*a*, 26*b*, 26*c*, shown in FIG. 3. Referring again to FIG. 2, the armature windings are coupled by a set of three-phase lines 28 to a converter input relay 30 and a pair of converter output relays 32*a*, 32*b*. An optional autotransformer 34 may be coupled between the converter output relay 32*b* and the converter input relay 30.

While the relays 30, 32*a* and 32*b* are shown as being single-phase devices, in the preferred embodiment these relays are of the three-phase type, although they may instead be devices handling a different number of phases, as desired.

A DC link power converter 36 is coupled between the converter input relay and the converter output relay 32*a*. A filter 38 is coupled between a set of three-phase output lines 40 and a junction between the converter input relay 30 and the converter output relay 32. An internal power supply (IPS) 42 supplies power to the DC link power converter 36. A relay 44 selectively supplies control power to the IPS 42 from the converter input relay 30 or an auxiliary armature winding (not shown) of the DPMG 22. The IPS 42 also supplies power to a control unit 50.

The design of the DPMG 22, and particularly the provision therein of an auxiliary armature winding, is described in greater detail in the Shah, U.S. patent application Ser. No. 07/931,168, incorporated by reference hereinabove. If desired, a DPMG of another design not having an auxiliary winding may be used together with a relatively small auxiliary PMG driven by the prime mover 12 which produces control power. In this case, the DPMG may be one of the embodiments disclosed in the Lynch, et al., U.S. patent application Ser. No. 07/693,622, now U.S. Pat. No. 5,245,235 incorporated by reference herein above.

The power converter 36 includes switches operated by the control unit 50 in response to one or more sensed parameters. In the preferred embodiment, during operation in the generating mode, the power converter 36 is controlled based upon the detected voltage and current in one of the phase outputs of the system 10 as detected at a point of regulation (POR) at or near the load bus 16 and the magnitudes of voltage and current conducted over a DC link of the power converter 36. During operation in the starting mode, the control unit 50 operates the power converter in accordance with a sensed operational parameter of the DPMG 22, such as the position of the motive power shaft 24, the speed thereof and/or the magnitude of currents flowing in the armature windings 26*a*–26*c*.

Figure 3:
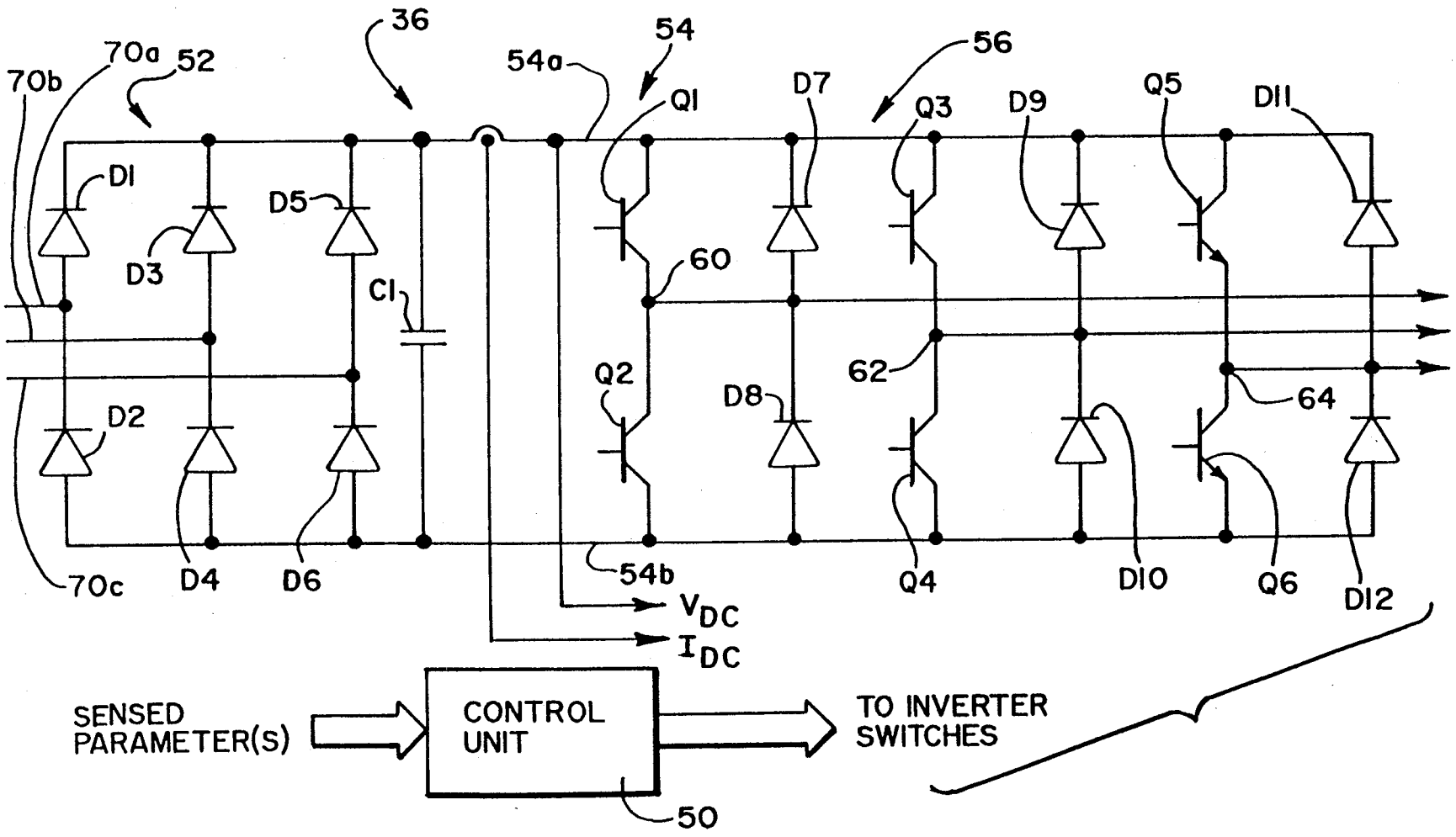
FIG. 3 is a simplified schematic diagram of the DC link power converter of FIG. 2.

Referring now to FIG. 3, the DC link power converter 36 includes an AC/DC converter 52 in the form of a three-phase full-wave rectifier bridge comprising diodes D1–D6 together with a smoothing capacitor C1. The rectifier bridge 52 is coupled to a DC link 54 comprising DC link conductors 54*a* and 54*b* and a DC/AC converter or inverter 56 is coupled to the DC link 54 and includes controllable power switches in the form of transistors Q1–Q6 connected with flyback diodes D7–D12 in a conventional three-phase bridge configuration. The inverter 56 includes three-phase outputs 60, 62 and 64 which are connected to the converter 20 output relay 32*a*.

Referring again to FIG. 2, during operation in the starting mode, the relays 30, 32*a* and 32*b* are in the illustrated positions. In addition, the contactors 14*a*–14*c* and 20*a*–20*c* are closed so that the external AC power source 18 connected to the load bus 16 is coupled to the filter 38. Also, the output of the filter 38 is coupled through the relay 30 to the DC link power converter 36. The AC power supplied by the power source 18 is provided to a set of inputs 70*a*, 70*b* and 70*c* of the power converter 36. The phase outputs 60, 62 and 64 of the power converter are coupled by the converter output relay 32*a* to the armature windings 26*a*–26*c*, respectively, of the DPMG 22. In a first embodiment, the control unit 50 detects the position of the motive power shaft 24 and operates the switches Q1–Q6 in a conventional fashion to operate the DPMG 22 as a brushless DC motor. In this embodiment, the inverter 56 supplies power to the DPMG 22 to accelerate the motive power shaft 24 in a controlled fashion. According to known control techniques, the voltage, current and/or phase of the power supplied to the armature windings 26*a*–26*c* may be adjusted so that torque, acceleration and/or speed can be controlled.

In an alternative embodiment, the speed of rotation of the shaft 24 is detected and the switches Q1–Q6 are operated in a conventional fashion to operate the DPMG 22 as brushless DC motor. This embodiment results in a system having lower cost and weight if operation at less than peak torque is acceptable. The power converter 36 ramps up the output voltage and frequency following a precalculated profile and speed feedback provides a check on correct operation.

During operation in the starting mode, a power factor as high as 0.92 can be achieved by regulating the angle between the two rotors of the DPMG 22. Control of the angle between the permanent magnet structures of the DPMG to control power factor is analogous to the control of excitation of a wound field machine to accomplish the same result and connection circuits can be adapted to provide this control. For example, an open-loop control can be provided wherein DPMG speed is detected and converted by a profile generator and an appropriate gain and compensation unit to a command for an actuator controlling the angle between the rotors until a particular DPMG speed is reached. Thereafter, a closed-loop control could be used wherein actual and commanded power factors are subtracted to create an error which is integrated by an integrator, if necessary, and compensated by a gain and compensation unit to develop the actuator command.

During operation in the generating mode, the relays 30, 32*a* and 32*b* are moved to the positions opposite that shown in FIG. 2. Thus, the armature windings 26*a*–26*c* of the DPMG 22 are coupled by the set of lines 28 to the converter output relay 32*b* and the autotransformer 34. The autotransformer 34 is, in turn, coupled through the converter input relay 30 to the inputs 70*a*–70*c* of the power converter 36. The outputs 60, 62, 64 of the power converter 36 are coupled by the converter output relay 32*a* to the filter 38 and thence to the output lines 40.

During operation in the generating mode, the control unit 50 operates the switches Q1–Q6 such that substantially constant-frequency voltages are produced at the outputs 60, 62 and 64.

In addition to a substantial weight reduction, the axial gap DPMG offers the benefits of overall size reduction, higher efficiency, inherent ruggedness, high reliability, simplicity, reduction in overhung moment, absence of a rotating winding and diodes and protection of the system in the case of a differential fault.

Further, maximum excitation is available to provide maximum torque with minimum armature current and lower converter losses as compared with a wound-field brushless generator. Lower armature current results in the need for a smaller power converter. Also, a power source such as an additional converter is not required to deliver excitation. Still further, the converter and generator present a lower heat load during start as compared with systems using a wound-field brushless generator, no low-speed limitation is encountered due to the heating of motor diodes because of poor cooling during such operation and heavy exciter losses are eliminated.

While the system disclosed in the present application uses a single power converter operable in the starting and generating modes, it should be noted that two separate power converters may instead be used, are operable in the starting mode and are operable in the generating mode.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A starting/generating system operable in a starting mode and in a generating mode, comprising:

a dual permanent magnet generator (DPMG) having a motive power shaft and an armature winding;

a power converter having an input and an output;

relays operable in the starting mode to connect the output of the power converter to the DPMG armature winding and operable in the generating mode to connect the input of the power converter to the DPMG armature winding;

means operable in the starting mode for controlling the power converter whereby the DPMG is operated as a motor to produce motive power at the motive power shaft; and means operable in the generating mode for controlling the power converter whereby electrical power developed in the DPMG armature winding is converted into output power.

2. The starting/generating system of claim 1, in combination with a prime mover coupled to the motive power shaft wherein the motive power produced by the DPMG during operation in the starting mode is supplied to the prime mover to bring the prime mover up to self-sustaining speed and wherein motive power produced by the prime mover during operation in the generating mode is supplied to the DPMG.

3. The starting/generating system of claim 1, in combination with a source of AC power coupled to the input of the power converter during operation in the starting mode.

4. The starting/generating system of claim 1, wherein the DPMG includes dual permanent magnet rotor structures and a stator armature winding.

5. The starting/generating system of claim 1, wherein the DPMG includes a permanent magnet rotor structure and dual series-connected stator armature windings.

6. The starting/generating system of claim 1, wherein the power converter comprises a rectifier coupled between the input of the power converter and a DC link and an inverter coupled between the DC link and the output of the power converter.

7. The starting/generating system of claim 6, wherein the controlling means includes means for sensing a parameter of operation of the DPMG during operation in the starting mode and means responsive to the sensing means for operating the inverter to control the application of power to the armature winding during operation in the starting mode.

8. The starting/generating system of claim 7, wherein the sensing means comprises a position resolver which detects the position of the motive power shaft.

9. The starting/generating system of claim 7, wherein the sensing means comprises a speed detector which detects the speed of rotation of the motive power shaft.

10. A starting/generating system operable in a starting mode to accelerate a prime mover to operating speed and in a generating mode to convert motive power supplied by the prime mover into electrical power for a load, comprising:

a dual permanent magnet generator (DPMG) having a rotor coupled to the prime mover through a motive power shaft, a magnetic structure on the rotor and an armature winding;

an uncontrolled rectifier bridge having an input and an output;

an inverter having an input coupled to the rectifier output and an output;

an AC power source;

relays operable in the starting mode to connect the AC power source to the rectifier input and the output of the inverter to the DPMG armature winding and operable in the generating mode to connect the rectifier bridge input to the DPMG armature winding; and an inverter control operable in the starting mode for controlling the inverter whereby the DPMG is operated as a motor to produce motive power at the motive power shaft and operable in the generating mode for controlling the inverter whereby electrical power developed in the DPMG armature winding is converted into AC output power.

11. The starting/generating system of claim 10, wherein the DPMG includes dual permanent magnet rotor structures and a stator armature winding.

12. The starting/generating system of claim 10, wherein the DPMG includes a permanent magnet rotor structure and dual series-connected stator armature windings.

13. A method of operating a starting/generating system, comprising the steps of:

(a.) coupling a motive power shaft of a dual permanent magnet generator (DPMG) to a prime mover;

(b.) connecting an output of a power converter to an armature winding of the DPMG;

(c.) connecting an input of the power converter to a power source;

(d.) controlling the power converter whereby the DPMG is operated as a motor to produce motive power which is transferred through the motive power shaft to the prime mover so that the prime mover is accelerated to self-sustaining speed;

(e.) connecting the input of the power converter to the DPMG armature winding and the output of the power converter to a load after the step (d.); and (f.) controlling the power converter whereby electrical power developed in the DPMG armature winding is converted into output power for the load.

14. The method of claim 13, wherein the step (d.) comprises the step of operating the DPMG as a brushless DC motor.

15. The method of claim 14, wherein the step of operating includes sensing the position of the motive power shaft.

16. The method of claim 14, wherein the step of operating includes sensing the speed of the motive power shaft.

17. The method of claim 13, wherein the step (f.) comprises operating the power converter such that AC power at a substantially constant-frequency is produced thereby.

* * * * *